US006854672B2

(12) United States Patent
Allen

(10) Patent No.: US 6,854,672 B2
(45) Date of Patent: Feb. 15, 2005

(54) AIR-ASSISTED AIR VALVE FOR AIR ATOMIZED SPRAY GUNS

(75) Inventor: Harold T. Allen, Indianapolis, IN (US)

(73) Assignee: Illinois Tool Works Inc., Glenview, IL (US)

( * ) Notice: Subject to any disclaimer, the term of this patent is extended or adjusted under 35 U.S.C. 154(b) by 112 days.

(21) Appl. No.: 10/192,890

(22) Filed: Jul. 11, 2002

(65) Prior Publication Data

US 2004/0007634 A1 Jan. 15, 2004

(51) Int. Cl.[7] ..... B05B 5/00
(52) U.S. Cl. ..... 239/705; 239/690; 239/571
(58) Field of Search ..... 239/705, 690, 239/571, 569, 570, 583, 584, 589, 590.5, 591, 704

(56) References Cited

U.S. PATENT DOCUMENTS

| | | | | | |
|---|---|---|---|---|---|
| 2,888,176 | A | * | 5/1959 | Miller | 222/396 |
| 3,169,882 | A | | 2/1965 | Juvinall et al. | |
| 4,002,777 | A | | 1/1977 | Juvinall et al. | |
| 4,285,446 | A | | 8/1981 | Rapp et al. | |
| 4,802,627 | A | * | 2/1989 | Moy et al. | 239/112 |
| 4,824,026 | A | * | 4/1989 | Tamura et al. | 239/707 |
| 5,219,097 | A | * | 6/1993 | Huber et al. | 222/145.2 |
| 5,261,610 | A | * | 11/1993 | Waryu et al. | 239/585.4 |
| 5,787,928 | A | * | 8/1998 | Allen et al. | 137/625.43 |
| 6,425,533 | B1 | * | 7/2002 | Shilton et al. | 239/290 |
| 6,644,295 | B2 | * | 11/2003 | Jones | 124/77 |

FOREIGN PATENT DOCUMENTS

| | | | | |
|---|---|---|---|---|
| EP | 0 846 904 A1 | | 6/1998 | |
| WO | WO 9413404 A1 | * | 6/1994 | B05B/07/12 |

OTHER PUBLICATIONS

"REA–90 and REA–90L Electrostatic Spray Guns Dual Atomization Technology", ITW Ransburg Eletrostatic Systems, Service Manual AH–94–Apr. 3, 2001.

* cited by examiner

*Primary Examiner*—Thomas Denion
*Assistant Examiner*—Ching Chang
(74) *Attorney, Agent, or Firm*—Barnes & Thornburg

(57) ABSTRACT

A coating material dispensing device includes a port adapted to be coupled to a source of coating material, an actuator for controlling a flow of compressed gas through the dispensing device, and a valve coupled to the actuator to be controlled by the actuator. The valve includes a valve housing, a valve closure member, and a valve seat. The valve closure member is movable in the housing under the control of the actuator between a closed position against the valve seat and an open position away from the valve seat. An inlet port is provided into the housing. The inlet port is oriented on a first side of the valve seat. The inlet port is adapted to be coupled to a source of the compressed gas. An outlet port is provided on the second side of the valve seat. The valve closure member includes a first surface which faces generally in a first direction of movement of the valve closure member away from the valve seat and a second surface which faces generally in a second direction of movement of the valve closure member toward the valve seat.

24 Claims, 2 Drawing Sheets

PRIOR ART

AIR-ASSISTED AIR VALVE FOR AIR ATOMIZED SPRAY GUNS

FIELD OF THE INVENTION

This invention relates to a valve structure. It is disclosed in the context of a structure for an air valve for a dispensing device, such as a handheld coating material dispensing device, sometimes referred to hereinafter as a handgun or gun. However, it is believed to have other applications as well.

BACKGROUND OF THE INVENTION

Handheld coating material dispensing devices of various types are well-known. There are, for example, the guns illustrated and described in U.S. Pat. Nos. 3,169,882; 4,002,777; and, 4,285,446. There are also the Ransburg model REA 3, REA 4, REA 70, REA 90, REM and M-90 guns, all available from ITW Ransburg, 320 Phillips Avenue, Toledo, Ohio, 43612-1493. No representation is intended by this listing that a thorough search of all material prior art has been conducted, or that no better art than that listed is available. Nor should any such representation be inferred.

DISCLOSURE OF THE INVENTION

According to an aspect of the invention, a coating material dispensing device includes a port adapted to be coupled to a source of coating material, an actuator for controlling a flow of compressed gas or mixture of gases (hereinafter sometimes "compressed gas" or "gas") through the dispensing device, and a valve coupled to the actuator to be controlled by the actuator. The valve includes a valve housing, a valve closure member, and a valve seat. The valve closure member is movable in the housing under the control of the actuator between a closed position against the valve seat and an open position away from the valve seat. An inlet port is provided into the housing. The inlet port is oriented on a first side of the valve seat. The inlet port is adapted to be coupled to a source of the compressed gas. An outlet port is provided on the second side of the valve seat. The valve closure member includes a first surface which faces generally in a first direction of movement of the valve closure member away from the valve seat and a second surface which faces generally in a second direction of movement of the valve closure member toward the valve seat. Means are provided for reducing exposure of the first surface to the source of compressed gas.

According to another aspect of the invention, a coating material dispensing system includes a coating material dispensing device, a source of coating material and a source of compressed gas. The coating material dispensing device includes a first port coupled to the source of coating material, a second port coupled to the source of compressed gas, an actuator for controlling a flow of gas through the dispensing device, and a valve coupled to the actuator to be controlled thereby. The valve includes a valve housing, a valve closure member, and a valve seat. The valve closure member is movable in the housing under the control of the actuator between a closed position against the valve seat and an open position away from the valve seat. The second port is coupled to a first side of the valve seat. A third port is provided on a second side of the valve seat. The valve closure includes a first surface which faces generally in a first direction of movement of the valve closure member away from the valve seat and a second surface which faces generally in a second direction of movement of the valve closure member toward the valve seat. Means are provided for reducing exposure of the first surface to the source of compressed gas.

Illustratively according to these aspects of the invention, the apparatus further includes means for urging the valve seat and valve closure member relatively toward each other to close the valve.

Additionally illustratively according to these aspects of the invention, the means for reducing exposure of the first surface to the source of the compressed gas includes a skirt extending from an outer perimeter of the closure member past the inlet port when the valve is in the closed position to reduce exposure of the first surface to the source of the compressed gas.

Illustratively according to these aspects of the invention, the skirt extends in the first direction from the closure member.

Further illustratively according to these aspects of the invention, the skirt extends entirely around a perimeter of the closure member to reduce exposure of the first surface to the source of the compressed gas.

Additionally illustratively according to these aspects of the invention, the housing includes a housing closure including a first seat. The first surface and skirt define a second seat. The means for urging the valve seat and valve closure member relatively toward each other to close the valve includes a spring for urging the valve seat and valve closure member relatively toward each other to close the valve. The spring is captured between the first and second seats.

According to another aspect of the invention, a valve for controlling the flow of a fluid includes a valve housing, a valve closure member, and a valve seat. The valve closure member is movable in the housing under the control of the actuator between a closed position against the valve seat and an open position away from the valve seat. An inlet port is provided into the housing for the fluid. The inlet port is oriented on a first side of the valve seat. An outlet port is provided for the fluid on the second side of the valve seat. The valve closure member includes a first surface which faces generally in a first direction of movement of the valve closure member away from the valve seat and a second surface which faces generally in a second direction of movement of the valve closure member toward the valve seat. Means are provided for reducing exposure of the first surface to the fluid.

Illustratively according to this aspect of the invention, the apparatus further includes means for urging the valve seat and valve closure member relatively toward each other to close the valve.

Additionally illustratively according to this aspect of the invention, the means for reducing exposure of the first surface to the fluid includes a skirt extending from an outer perimeter of the closure member past the inlet port when the valve is in the closed position to reduce exposure of the first surface to the fluid.

Illustratively according to this aspect of the invention, the skirt extends in the first direction from the closure member.

Further illustratively according to this aspect of the invention, the skirt extends entirely around a perimeter of the closure member to reduce exposure of the first surface to the fluid.

Additionally illustratively according to this aspect of the invention, the housing includes a housing closure including a first seat. The first surface and skirt define a second seat. The means for urging the valve seat and valve closure member relatively toward each other to close the valve includes a spring for urging the valve seat and valve closure member relatively toward each other to close the valve. The spring is captured between the first and second seats.

BRIEF DESCRIPTION OF THE DRAWINGS

The invention may best be understood by referring to the following detailed description and accompanying drawings which illustrate both the prior art and the invention. In the drawings.

DETAILED DESCRIPTIONS OF ILLUSTRATIVE EMBODIMENTS

Figure 1:
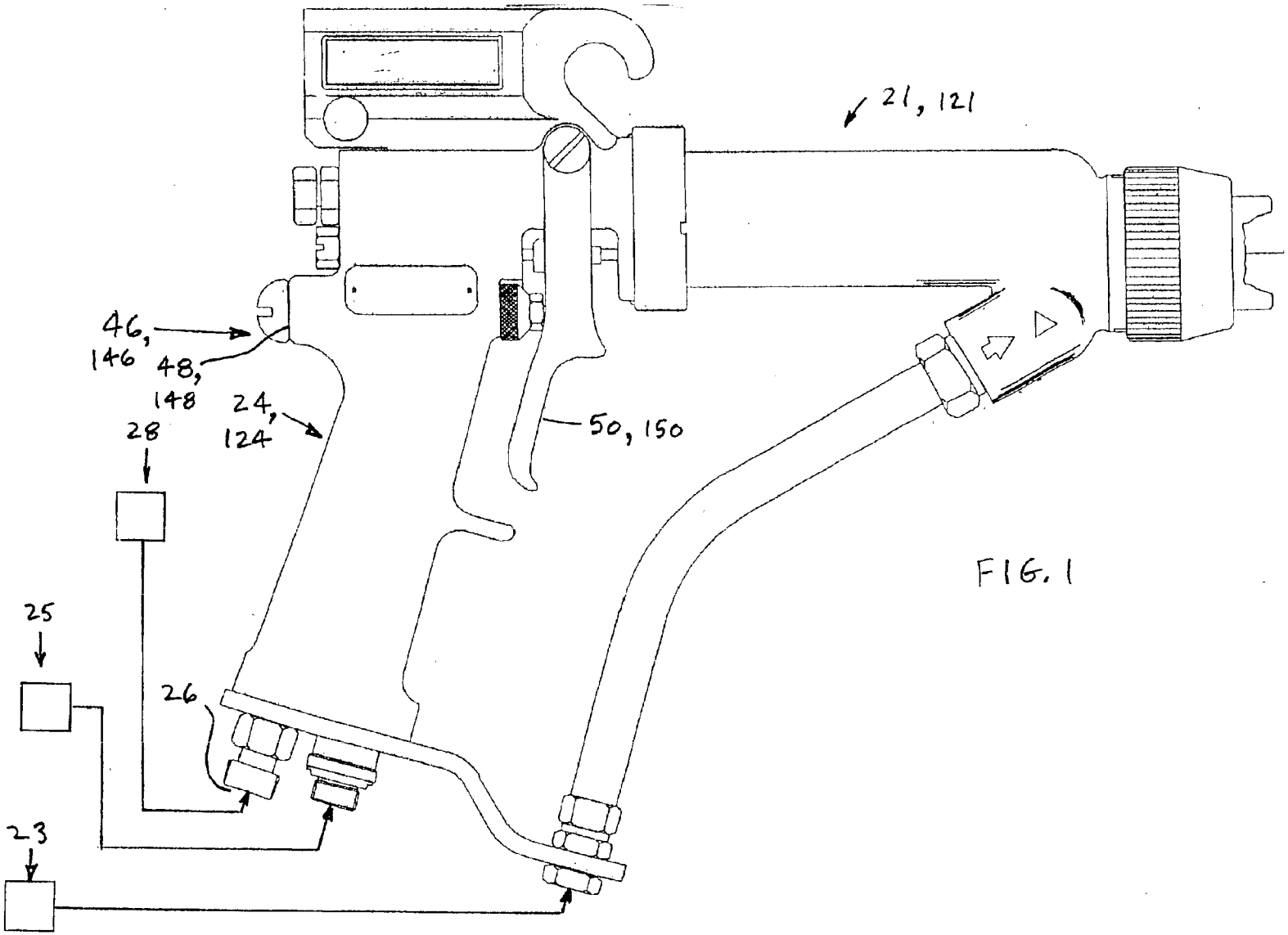
FIG. 1 illustrates a side elevational view of a gun of the general type in connection with which the invention is useful.
Figure 2:
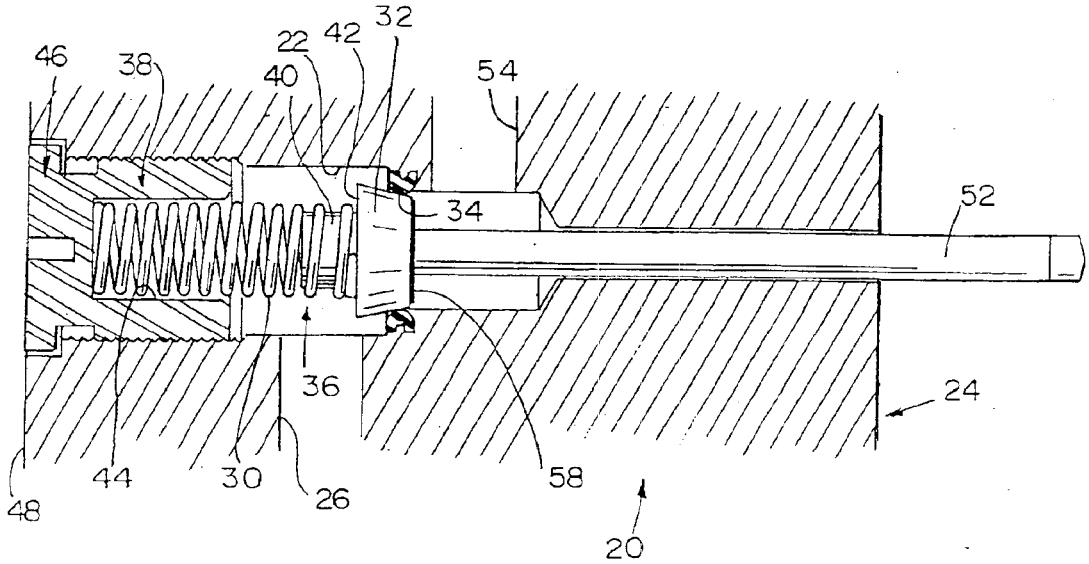
FIG. 2 illustrates a partly sectional side elevational view of a prior art trigger-controlled air valve; and, FIG. 3 illustrates a partly sectional side elevational view of a trigger-controlled air valve constructed according to the invention.

A prior art air valve 20 is illustrated in FIG. 2. Such valves 20 are used in a number of commercially available liquid coating dispensing guns 21. See FIG. 1. Guns 21 of this general type include, for example, the Ransburg model REA 3, REA 4, REA 70, REA 90, REM and M-90 all available from ITW Ransburg, 320 Phillips Avenue, Toledo, Ohio, 43612-1493. This listing is not exhaustive, as this is a common trigger air valve construction. Typically, gun 21 is coupled through appropriate fittings and the like to a source 23 of coating material to be atomized and dispensed from gun 21, a source 28 of compressed air, and a source 25 of high- or low-magnitude electrical potential, which is used in electrostatic charging and atomization of the coating material. Compressed air from source 28 is used, for example, in the process of atomizing and dispensing the coating material, cleaning the gun 21, and the like. Electrical potential from source 25 is used in electrostatic charging and atomization of the coating material. Sources 23, 28 and 25 are all illustrated in block diagram fashion in FIG. 1.

The valve 20 is housed in a passageway 22 formed in the generally pistol grip-shaped handle 24 of the gun 21. Air is supplied through a passageway 26 from compressed air source 28 to an upstream side of the valve 20 closure member 32. The air pressure, combined with the spring force provided by a coil spring 30, hold the air valve 20 closure member 32 against its seat 34 and seals the air off. The ends 36, 38 of the coil spring 30 are captured on a boss 40 provided on the upstream side 42 of the closure member 32 and in a well 44 provided in the slotted, threaded closure 46 which threads into the passageway 22 from the rear surface 48 of the handle 24.

The force applied by the operator of the gun 21 on the trigger 50 of gun 21 is transmitted through the valve 20's operating rod 52, pushing the rod 52 and closure member 32 rearward, and closure member 32 away from seat 34 to open the air valve 20 and permit air to flow in a passageway 54 upward and toward the front of gun 21. The force required to push the rod 52 and closure member 32 rearward is influenced by the pressure of the compressed air supplied from source 28. The higher the source 28 air pressure, the greater the force required by the operator to trigger the air valve 20 open. The force tends to be greatest just prior to opening of the valve 20. Once the valve closure member 32 moves away from the seat 34, the forces contributed by compressed air on the closure member 32 are brought closer to equilibrium, owing to the downstream side 58 of the closure member 32 being exposed to the pressure from source 28. This reduces the force required from the operator to keep the valve 20 open.

Figure 3:
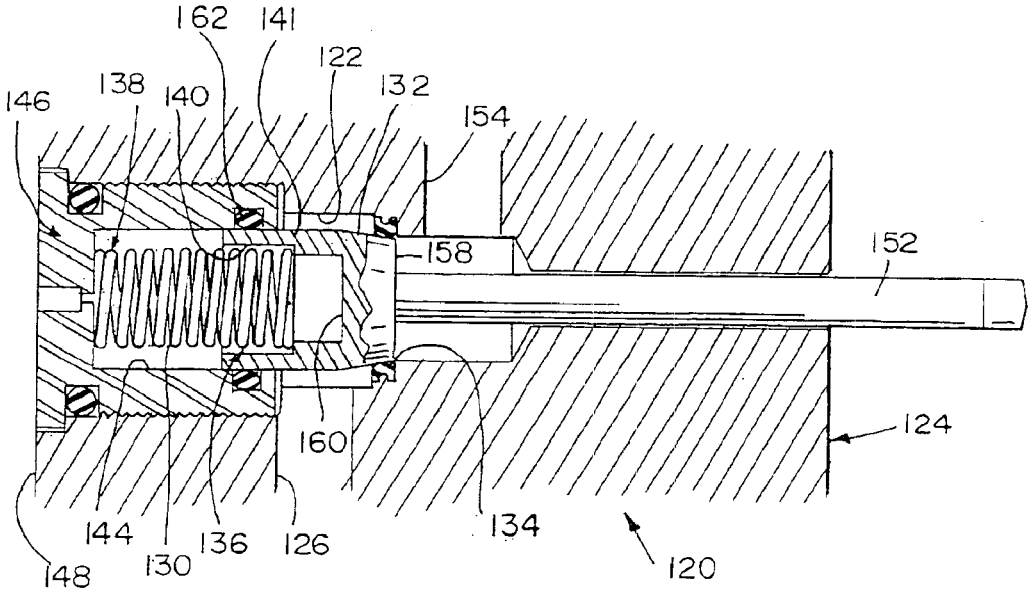

A valve 120 constructed according to the invention is illustrated in FIG. 3. Valve 120 is housed in a housing 122 formed in the generally pistol grip-shaped handle 124 of a gun 121. Air is supplied from a compressed air source 28 through port 126 which intersects housing 122 upstream of a valve seat 134. The source 28 pressure, combined with the spring force provided by a coil spring 130, hold a somewhat piston-shaped air valve closure member 132 against seat 134 and seals the air off. The ends 136, 138, respectively, of the coil spring 130 are captured in a well 140 provided by the rearwardly extending skirt 141 of closure member 132 and in a well 144 provided in the slotted, threaded closure 146 which threads into the housing 122 from the rear surface 148 of the handle 124.

The force applied by the operator of the gun 121 on the trigger 150 of gun 121 is transmitted through the valve 120's operating rod 152, pushing the rod 152 and closure member 132 rearward, and closure member 132 away from seat 134 to open the air valve 120 and permit air to flow in a passageway 154 upward and toward the front of gun 121. In valve 120, the upstream, or front, side 160 of the closure member 132 is isolated from the compressed air in port 126 by skirt 141 which extends rearwardly beyond the intersection of housing 122 and port 126. This means the front side 160 of valve closure member 132 is not exposed to the source 28 pressure. This results in a reduction of the force with which the valve 120 is maintained in its closed orientation, and therefore, the force required to open the valve 120.

A seal 162, for example, an O-ring seal, is provided between the wall of the housing 122 and the skirt 141. This reduces further the likelihood that the front side 160 of the closure member 132 will be exposed to the pressure in port 126. The force required to push the rod 152 and closure member 132 rearward is thus maintained substantially independent of the source 28 pressure when the valve 120 is closed. Once the valve 120 closure member 132 moves away from the seat 134, the force contributed by the source 28 pressure on the downstream side 158 of the closure member 132 partially counterbalances the spring 130 force on trigger 150. This helps to reduce the pressure which the operator needs to apply to trigger 150 to keep the valve 120 open.

In the illustrated embodiment, skirt 141 must extend around the entire perimeter of the closure member 132 to protect surface 160 from source 28 pressure. This is so because the diameter of skirt 141 is smaller than the diameter of housing 122 in the region of seat 134. Therefore, source 28 pressure is present all the way around closure member 132 when closure member 132 is away from seat 134. However, it should be appreciated that valve 120 designs are possible in which skirt 141 does not need to extend all the way around the perimeter of closure member 132 to isolate surface 160 from the source 28 pressure. This may only be, for example, as far as, or slightly farther than, port 126 extends around the perimeter of housing 122 at the intersection of port 126 with housing 122.

What is claimed is:

1. A coating material dispensing device including a port adapted to be coupled to a source of coating material, an actuator for controlling a flow of gas through the dispensing device, a valve coupled to the actuator to be controlled by the actuator, the valve including a valve housing, a valve closure member, a valve seat, the valve closure member movable in the housing under the control of the actuator between a closed position against the valve seat and an open position away from the valve seat, an inlet port into the housing, the inlet port oriented on a first side of the valve seat and adapted to be coupled to a source of the compressed gas, an outlet port on the second side of the valve seat, the valve closure member including a first surface which faces generally in a first direction of movement of the valve closure member away from the valve seat and a second surface which faces generally in a second direction of movement of the valve closure member toward the valve seat, and a skirt extending from an outer perimeter of the closure member past the inlet port when the valve is in the closed position for reducing exposure of the first surface to the source of compressed gas.

2. The apparatus of claim 1 further including means for urging the valve seat and valve closure member relatively toward each other to close the valve.

3. The apparatus of claim 1 wherein the skirt extends in the first direction from the closure member.

4. The apparatus of claim 1 wherein the skirt extends entirely around a perimeter of the closure member.

5. The apparatus of claim 1 wherein the housing includes a housing closure including a first seat, the first surface and skirt defining a second seat, the valve further including a spring for urging the valve seat and valve closure member relatively toward each other to close the valve, the spring captured between the first and second seats.

6. The apparatus of claim 5 wherein the skirt extends in the first direction.

7. The apparatus of claim 6 wherein the skirt extends entirely around a perimeter of the closure member.

8. The apparatus of claim 5 wherein the skirt extends entirely around a perimeter of the closure member.

9. A coating material dispensing system including a coating material dispensing device, a source of coating material and a source of compressed gas, the coating material dispensing device including a first port coupled to the source of coating material, a second port coupled to the source of compressed gas, an actuator for controlling a flow of gas through the dispensing device, a valve coupled to the actuator to be controlled thereby, the valve including a valve housing, a valve closure member, a valve seat, the valve closure member movable in the housing under the control of the actuator between a closed position against the valve seat and an open position away from the valve seat, the second port being coupled to a first side of the valve seat, a third port on a second side of the valve seat, the valve closure member including a first surface which faces generally in a first direction of movement of the valve closure member away from the valve seat and a second surface which faces generally in a second direction of movement of the valve closure member toward the valve seat, and a skirt extending from an outer perimeter of the closure member past the inlet port when the valve is in the closed position for reducing exposure of the first surface to the source of compressed gas.

10. The apparatus of claim 9 further including means for urging the valve seat and valve closure member relatively toward each other to close the valve.

11. The apparatus of claim 9 wherein the skirt extends in the first direction from the closure member.

12. The apparatus of claim 9 wherein the skirt extends entirely around a perimeter of the closure member.

13. The apparatus of claim 9 wherein the housing includes a housing closure including a first seat, the first surface and skirt defining a second seat, the valve further including a spring for urging the valve seat and valve closure member relatively toward each other to close the valve, the spring captured between the first and second seats.

14. The apparatus of claim 13 wherein the skirt extends in the first direction.

15. The apparatus of claim 14 wherein the skirt extends entirely around a perimeter of the closure member.

16. The apparatus of claim 13 wherein the skirt extends entirely around a perimeter of the closure member.

17. A valve for controlling the flow of a fluid, the valve including a valve housing, a valve closure member, a valve seat, the valve closure member movable in the housing under the control of an actuator between a closed position against the valve seat and an open position away from the valve seat, an inlet port into the housing for the fluid, the inlet port oriented on a first side of the valve seat, an outlet port for the fluid on the second side of the valve seat, the valve closure member including a first surface which faces generally in a first direction of movement of the valve closure member away from the valve seat and a second surface which faces generally in a second direction of movement of the valve closure member toward the valve seat, and a skirt extending from an outer perimeter of the closure member past the inlet port when the valve is in the closed position for reducing exposure of the first surface to the fluid.

18. The apparatus of claim 17 further including means for urging the valve seat and valve closure member relatively toward each other to close the valve.

19. The apparatus of claim 17 wherein the skirt extends in the first direction from the closure member.

20. The apparatus of claim 17 wherein the skirt extends entirely around a perimeter of the closure member.

21. The apparatus of claim 17 wherein the housing includes a housing closure including a first seat, the first surface and skirt defining a second seat, the valve further including a spring for urging the valve seat and valve closure member relatively toward each other to close the valve, the spring captured between the first and second seats.

22. The apparatus of claim 21 wherein the skirt extends in the first direction.

23. The apparatus of claim 22 wherein the skirt extends entirely around a perimeter of the closure member.

24. The apparatus of claim 21 wherein the skirt extends entirely around a perimeter of the closure member.

* * * * *